US009705269B2

(12) United States Patent
Zhang

(10) Patent No.: US 9,705,269 B2
(45) Date of Patent: Jul. 11, 2017

(54) USB SOCKET CONNECTOR

(71) Applicant: Xiaomi Inc., Beijing (CN)

(72) Inventor: Lin Zhang, Beijing (CN)

(73) Assignee: XIAOMI INC., Beijing (CN)

( * ) Notice: Subject to any disclaimer, the term of this patent is extended or adjusted under 35 U.S.C. 154(b) by 0 days.

(21) Appl. No.: 15/065,833

(22) Filed: Mar. 9, 2016

(65) Prior Publication Data

US 2017/0040759 A1 Feb. 9, 2017

(30) Foreign Application Priority Data

Aug. 5, 2015 (CN) ..... 2015 1 0472657

(51) Int. Cl.

| | |
|---|---|
| ***H01R 24/62*** | (2011.01) |
| ***H01R 13/74*** | (2006.01) |
| ***H01R 13/502*** | (2006.01) |
| *H01R 13/512* | (2006.01) |
| *H01R 24/60* | (2011.01) |
| *H01R 107/00* | (2006.01) |

(52) U.S. Cl.

CPC ..... *H01R 24/62* (2013.01); *H01R 13/502* (2013.01); *H01R 13/748* (2013.01); *H01R 13/512* (2013.01); *H01R 24/60* (2013.01); *H01R 2107/00* (2013.01)

(58) Field of Classification Search

CPC ..... H01R 23/62; H01R 13/502; H01R 24/62; H01R 13/512; H01R 13/748; H01R 24/60

USPC ... 439/540.1, 76.1, 541.5, 676, 660, 607.07, 439/607.11, 607.13, 607.14, 607.2, 439/607.32, 607.4, 607.55; 361/749.45; 174/50.54, 50.52, 50

See application file for complete search history.

(56) References Cited

U.S. PATENT DOCUMENTS 6,676,419 B1 * 1/2004 Lin ..... G06K 19/077 439/131
7,175,443 B2 * 2/2007 Mizuno ..... H01R 13/56 439/374

(Continued)

FOREIGN PATENT DOCUMENTS

CN 202651442 U 1/2013
CN 103682765 A 3/2014

(Continued)

OTHER PUBLICATIONS

International Search Report in international application No. PCT/CN2015/098888, mailed on May 11, 2016.

(Continued)

*Primary Examiner* — Harshad Patel
(74) *Attorney, Agent, or Firm* — Jun He Law Offices P.C.; James J. Zhu

(57) ABSTRACT

A universal serial bus (USB) socket connector and an electronic device with the USB socket connector are disclosed. The USB socket connector is disposed in an electronic device for plugging with a plug connector. A plug hole for insertion of the plug connector to plug is disposed on a device shell of the electronic device. The USB socket connector includes a base and a connection terminal component. The base is fixed on the device shell, a receiving slot corresponding to the plug hole is disposed on the base, and the connection terminal component is assembled inside the receiving slot.

8 Claims, 4 Drawing Sheets

(56) References Cited

U.S. PATENT DOCUMENTS

| | | | | |
|---|---|---|---|---|
| 8,011,952 | B1 * | 9/2011 | Zhong | H01R 13/447 439/540.1 |
| 8,908,371 | B2 * | 12/2014 | Ariga | H05K 5/0026 361/679.55 |
| 2003/0171014 | A1 * | 9/2003 | Lin | H01R 12/707 439/79 |
| 2006/0019513 | A1 * | 1/2006 | Mizuno | H01R 13/56 439/76.1 |
| 2009/0284906 | A1 * | 11/2009 | Yang | H01R 13/5213 361/679.01 |
| 2009/0316368 | A1 * | 12/2009 | Hiew | G06F 1/1632 361/737 |
| 2010/0022107 | A1 * | 1/2010 | Hou | H05K 5/0278 439/131 |
| 2010/0029138 | A1 * | 2/2010 | Yu | H01R 13/518 439/660 |
| 2011/0058329 | A1 * | 3/2011 | Lin | H05K 5/0282 361/679.45 |
| 2012/0129397 | A1 * | 5/2012 | Chen | H01R 13/514 439/607.24 |
| 2013/0164983 | A1 * | 6/2013 | Ju | H01R 13/6581 439/607.55 |
| 2014/0078695 | A1 | 3/2014 | Shih et al. | |
| 2014/0162483 | A1 | 6/2014 | Chu | |
| 2015/0200504 | A1 | 7/2015 | Little et al. | |

FOREIGN PATENT DOCUMENTS

| | | | |
|---|---|---|---|
| CN | 203596427 | U | 5/2014 |
| CN | 203911161 | U | 10/2014 |
| CN | 204179374 | U | 2/2015 |
| CN | 104810688 | A | 7/2015 |
| CN | 204497410 | U | 7/2015 |
| CN | 105098438 | A | 11/2015 |
| JP | 3195845 | U | 1/2015 |
| JP | 3195845 | U | 2/2015 |

OTHER PUBLICATIONS

Supplementary European Search Report in European application No. 16158536.9, mailed on Dec. 5, 2016.

* cited by examiner

USB SOCKET CONNECTOR

CROSS-REFERENCE TO RELATED APPLICATIONS

This application is based upon and claims priority to Chinese Patent Application No. 201510472657.2, filed Aug. 5, 2015, the entire contents of which are incorporated herein by reference.

TECHNICAL FIELD

The present disclosure relates to the field of electronic device, and more particularly, to a universal serial bus (USB) socket connector and an electronic device with the USB socket connector.

BACKGROUND

Communication between electronic devices is usually accomplished by transmission of an electrical signal through an electrical connector connected therebetween, for example, a USB electrical connector commonly used at present. The USB Implementation Forum (USB-IF) declared the USB Type-C interface of an electrical connector for USB devices in 2014. The USB Type-C interface has the advantage of supporting both positive and reverse plugging. At present, there is a trend of replacing the existing Micro USB interface on the mobile phone with the USB Type-C interface in the whole mobile phone industry, thereby making the USB Type-C interface become a standardized interface in the industry.

As shown in FIG. 1, in order to make the rigidity of the USB interface compliant to the specification published by the USB-IF, the existing USB Type-C interface 2' is added with a protection shell 21' outside of a connection terminal, so as to guarantee enough rigidity of the connection terminal inside the USB Type-C interface 2' when the plug connector 3' swings along the X direction and the Z direction. However, the addition of the protection shell 21' increases difficulty in the design process of the mobile phone, and even makes the design requirement of mobile phone not able to be met when designing an ultrathin mobile phone.

SUMMARY

According to a first aspect of embodiments of the present disclosure, there is provided a USB socket connector disposed in an electronic device for connecting with a plug connector. A plug hole for insertion of the plug connector is disposed on a device shell of the electronic device, and the USB socket connector includes a base and a connection terminal component. Moreover, the base is fixed on the device shell, a receiving slot corresponding to the plug hole is disposed on the base, and the connection terminal component is assembled inside the receiving slot.

According to a second aspect of embodiments of the present disclosure, there is provided an electronic device, which includes a device shell and a USB socket connector. A plug hole for insertion of a plug connector is disposed on the device shell, and the USB socket connector is provided for connecting with the plug connector. Moreover, the USB socket connector includes a base and a connection terminal component; wherein the base is fixed on the device shell, a receiving slot corresponding to the plug hole is disposed on the base, and the connection terminal component is assembled inside the receiving slot.

It is to be understood that both the foregoing general description and the following detailed description are exemplary and explanatory only and are not restrictive of the invention.

BRIEF DESCRIPTION OF THE DRAWINGS

The accompanying drawings, which are incorporated herein and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

The terms used in embodiments of the present disclosure are only intended to describe the specific examples, but not intended to limit the present disclosure. The singular forms "a", "said" and "the" which are used in embodiments of the present disclosure and the attached claims are intended to include the plural form, unless the context clearly dictates otherwise. It should also be understood that the term "and/or" used in this application is and includes any combination or all possible combinations of one or multiple associated items listed.

It should be understood that although a first, a second and other terms may be applied to describing various information in embodiments of the present disclosure, these information should not be limited to these terms. These terms are only used for differentiating the same type of information. For example, without departing from the scope of embodiments of the present disclosure, the first information can also be called the second information. Similarly, the second information can also be called the first information. Depending on the context, the word "if" used here can be explained as "while" or "when" or "in response to determining that".

Figure 1:
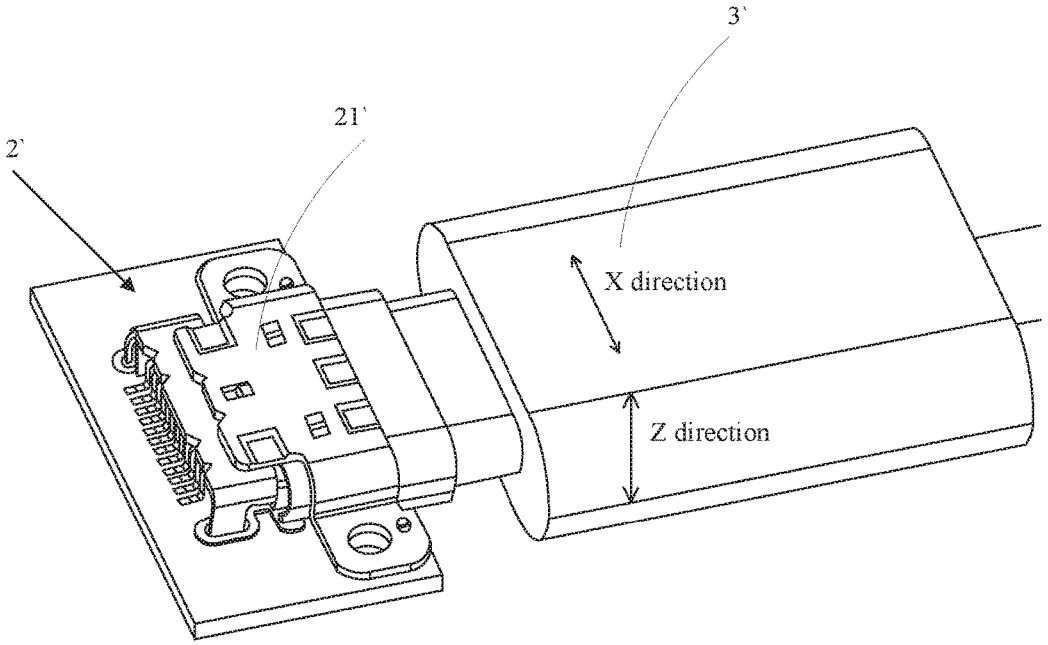
(Prior art) Fig. 1
FIG. 1 is a structure diagram illustrating a USB socket connector in the prior art.
Figure 2:
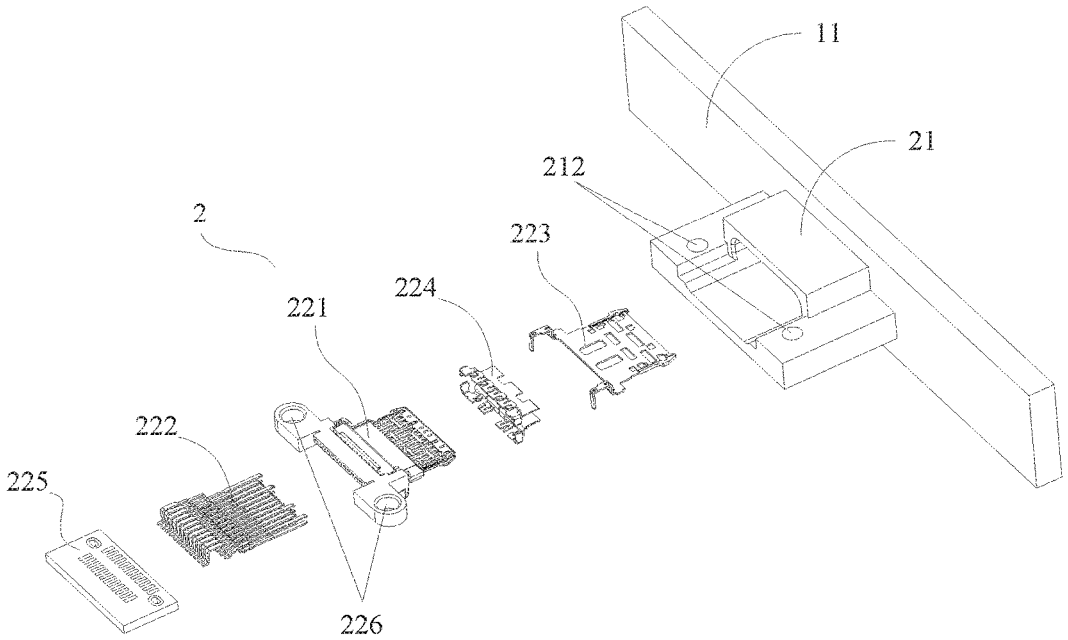
FIG. 2 is a diagram illustrating a breakdown structure of a USB socket connector according to an embodiment of the present disclosure.
Figure 3:
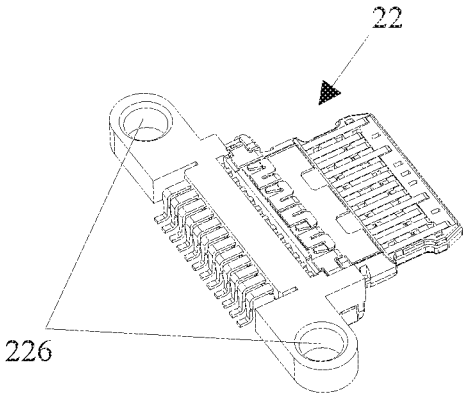
FIG. 3 is a diagram illustrating an overall structure of a connection terminal component according to an embodiment of the present disclosure.
Figure 4:
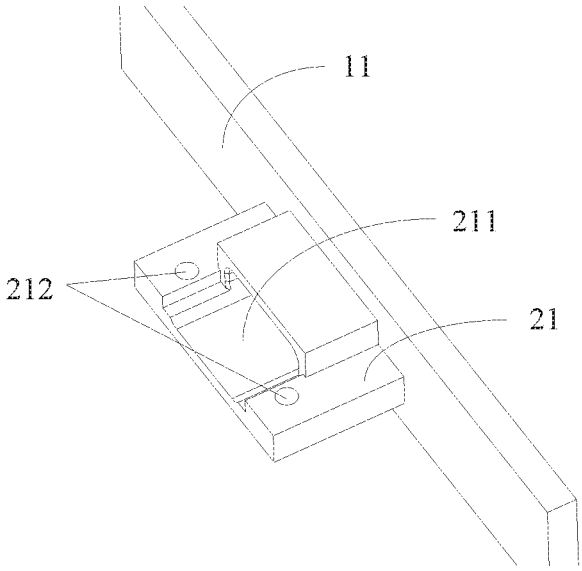
FIG. 4 is a structure diagram illustrating a base and a device shell of the USB socket connector according to an embodiment of the present disclosure.
Figure 5:
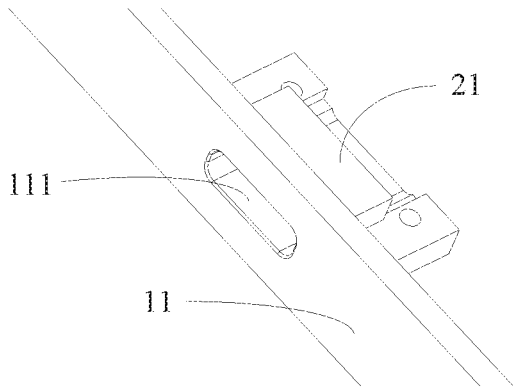
FIG. 5 is another structure diagram illustrating the base and the device shell of the USB socket connector according to an embodiment of the present disclosure.
Figure 6:
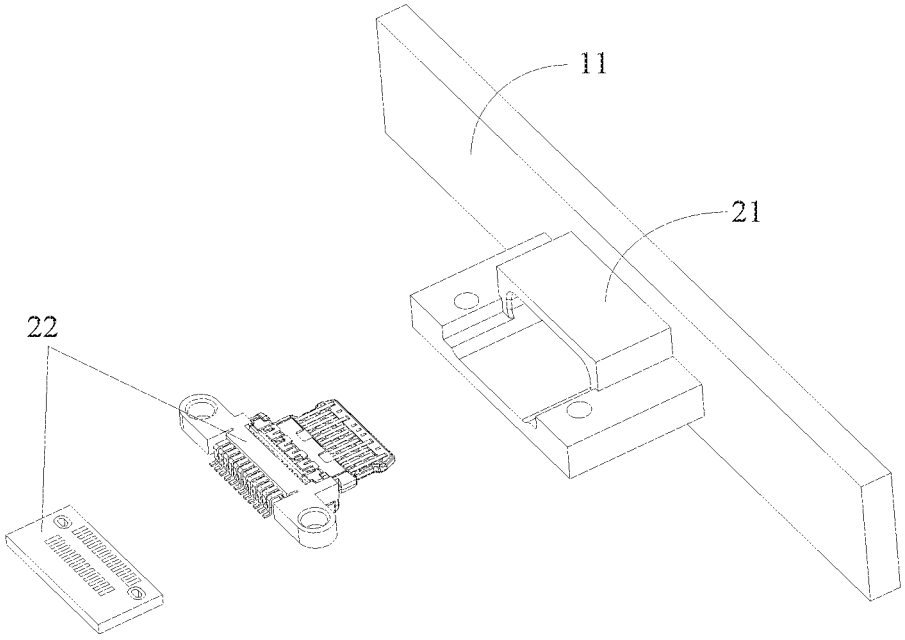
FIG. 6 is a diagram illustrating a part of breakdown structure of the USB socket connector according to an embodiment of the present disclosure.
Figure 7:
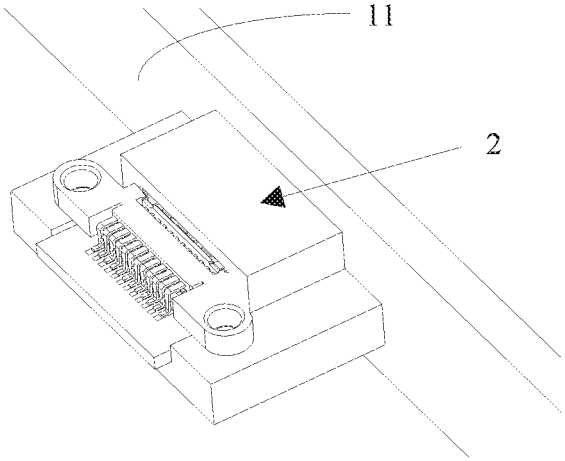
FIG. 7 is a diagram illustrating an overall structure of the USB socket connector in according to an embodiment of the present disclosure.

FIG. 2 is a diagram of a breakdown structure of a USB socket connector according to an embodiment of the present disclosure. In the embodiments of the present disclosure, a USB socket connector 2 with a new structure is disclosed, which eliminates the need for the protection shell in the prior art and replaces the protection shell in the prior art with a base 21 disposed integratedly with a device shell 11. Such deposition not only guarantees the rigidity of the USB socket connector 2, but also saves some space for the ultrathin design of the electronic device.

As shown in FIG. 2 to FIG. 7, a USB socket connector according to the present disclosure is described in detail by examples of the USB socket connector applied in a mobile phone in combination with the diagrams. The USB socket connector 2 according to the present disclosure is disposed inside an electronic device (not shown) for connecting with a plug connector (not shown). A plug hole 111 for insertion of the plug connector is disposed on the device shell 11 (only a part of the device shell is exemplarily shown in the diagrams) of the electronic device. The USB socket connector 2 shall be disposed to align to the plug hole 111 of the device shell 11 of the electronic device. The USB socket connector 2 includes a base 21 and a connection terminal component 22. Furthermore, the base 21 is fixed on the device shell 11. A receiving slot 211 corresponding to the plug hole 111 is disposed on the base 21. The connection terminal component 22 is assembled inside the receiving slot 211. Preferably, the base 21 and the device shell 11 are integratedly formed, and extend from an inner side surface of the device shell 11 to align to the plug hole 111. Since the receiving slot 211 is disposed on the firm base 21, the need for the protection shell in the prior art is eliminated and enough rigidity of the connection terminal in the USB socket connector 2 is guaranteed when the plug connector swings up and down, or left and right. In addition, the base 21 according to the present disclosure is disposed at the inner side of the device shell 11, which does not occupy the space in a thickness direction of the device shell 11, thereby meeting the development trend of smaller and thinner electronic device.

Referring to FIG. 2 again, the connection terminal component 22 according to the present disclosure includes an insulated body 221, a connection terminal 222 assembled on the insulated body 221, a first reinforce panel 223 for reinforcing rigidity of the connection terminal 222, a second reinforce panel 224 clamped on a root part of the connection terminal 222, and a printed circuit board (PCB) 225 disposed at the root part of the connection terminal 222 and electrically connected with the connection terminal 222. The PCB 225 is electrically connected with a main board of the electronic device. The connection terminal 222 includes an upper connection terminal and a lower connection terminal, both the upper connection terminal and the lower connection terminal are symmetrically structured such that the USB socket connector 2 supports both positive and reverse plugging, thereby increasing convenience for users. In a preferred embodiment of the present disclosure, the first reinforce panel 223 is disposed between the upper connection terminal and the lower connection terminal for assisting in fixing the upper connection terminal and the lower connection terminal, thereby increasing the rigidity of the upper connection terminal and the lower connection terminal.

Furthermore, each of the two sides of the insulated body 221 according to the present disclosure respectively has a connection part 226 extending outward. An installation holes 212 for coordinating with each of the connection parts 226 is correspondingly disposed on the base 21. Specifically, the connection part 226 according to the specification is a through hole. By fitting a connection component, such as a bolt or a rivet, through the connection part 226 and fixing the connection component to the installation hole 212, the connection terminal component 22 is entirely fixed on the base 21. The base 21 plays a role of protecting the connection terminal component 22. In the embodiment of the present disclosure, the USB socket connector 2 is formed by assembling the connection terminal component 22 on the base 21, so the number of process steps in the manufacturing process is decreased and the difficulty is reduced, and the USB socket connector is easy to be assembled on electronic devices.

In embodiments of the present disclosure, the connection terminal component 22 is protected by the base 21 disposed on the device shell 11. The receiving slot 211 on the base 21 provides a stable connection hole for the plug connector while eliminating the need for the protection shell in the prior art. It can also be understood that the protection shell and the device shell 11 are designed to be one, thereby saving the space in a thickness direction of the electronic device, and providing more available space for design of an ultrathin electronic device.

According to a second aspect of the present disclosure, an electronic device is also provided, which includes a device shell 11 and a USB socket connector 2 described as above. A plug hole 111 for insertion of a plug connector is disposed on the device shell 11. The USB socket connector 2 is provided for plugging with the plug connector. Detailed structure and function of the USB socket connector 2 may be referred to the above description of the USB socket connector and are not repeated here. Herein, the electronic device may be a mobile phone, a tablet computer, a personal digital assistant, and so on.

According to the present disclosure, a USB socket connector and an electronic device with the USB socket connector are disclosed. The protection shell in the prior art is replaced by a base fixed on the device shell. The protection shell and the device shell are designed to be one. The space in thickness direction of a mobile phone is saved while conforming to the USB Type-C protocol, thereby providing more available space for design of an ultra-thin electronic device.

Other embodiments of the invention will be apparent to those skilled in the art in consideration of the specification and practice of the invention disclosed here. This application is intended to cover any variation, use, or adaptation of the invention following the general principles thereof and including such departures from the present disclosure as come within known or customary practice in the art. The specification and the embodiments are to be considered as exemplary only, and the true scope and spirit of the invention will be indicated by the following claims.

It will be appreciated that the present invention is not limited to the exact construction that has been described above and illustrated in the accompanying drawing. Variations and changes can be made without departing from the scope thereof. It is intended that the scope of the invention only be limited by the appended claims.

What is claimed is:

1. A universal serial bus (USB) socket connector disposed in an electronic device for plugging with a plug connector, wherein a plug hole for insertion of the plug connector is disposed on a device shell of the electronic device, and the USB socket connector comprises a base and a connection terminal component;

wherein the base is fixed on the device shell and extends from an inner side surface of the device shell to align to the plus hole, a receiving slot corresponding to the plug hole is disposed on the base, and the connection terminal component is assembled inside the receiving slot and electrically connects with the plus connector by inserting the plus connector into the plug-hole; and wherein the connection terminal component comprises an insulated body, a connection terminal assembled on the insulated body, a first reinforce panel assembled inside the connection terminal for reinforcing rigidity of the connection terminal, a second reinforce panel clamped on a root part of the connection terminal, and a printed circuit board (PCB) disposed at the root part of the connection terminal and electrically connected with the connection terminal.

2. The USB socket connector of claim 1, wherein the base and the device shell are integratedly formed.

3. The USB socket connector of claim 1, wherein each of the two sides of the insulated body has a connection part extending outward, and an installation hole for coordinating with each of the connection parts is correspondingly disposed on the base.

4. The USB socket connector of claim 1, wherein the receiving slot of the base is provided such that rigidity of the connection terminal component can be guaranteed when the plug connector swings up and down, or left and right.

5. The USB socket connector of claim 1, wherein the base is disposed at an inner side of the device shell to avoid occupying space in a thickness direction of the device shell.

6. An electronic device, comprising a device shell and a universal serial bus (USB) socket connector, wherein a plug hole for insertion of a plug connector is disposed on the device shell, and the USB socket connector is provided for connecting with the plug connector;

wherein the USB socket connector comprises a base and a connection terminal component;

wherein the base is fixed on the device shell and extends from an inner side surface of the device shell to align to the plus hole, a receiving slot corresponding to the plug hole is disposed on the base, and the connection terminal component is assembled inside the receiving slot and electrically connects with the plus connector by inserting the plus connector into the plug-hole; and wherein the connection terminal component comprises an insulated body, a connection terminal assembled on the insulated body, a first reinforce panel assembled inside the connection terminal for reinforcing rigidity of the connection terminal, a second reinforce panel clamped on a root part of the connection terminal, and a printed circuit board (PCB) disposed at the root part of the connection terminal and electrically connected with the connection terminal.

7. The electronic device of claim 6, wherein the base and the device shell are integratedly formed.

8. The electronic device of claim 6, wherein each of the two sides of the insulated body has a connection part extending outward, and an installation hole for coordinating with each of the connection parts is correspondingly disposed on the base.

* * * * *